US009149826B2

(12) United States Patent
Vartanian et al.

(10) Patent No.: US 9,149,826 B2
(45) Date of Patent: Oct. 6, 2015

(54) MOUNTING SYSTEM FOR A SHOWER HEAD

(71) Applicants: Vagharshak Vartanian, Springfield, VA (US); Manvel J. Vartanian, Springfield, VA (US); Margaret Vartanian, Springfield, VA (US)

(72) Inventors: Vagharshak Vartanian, Springfield, VA (US); Manvel J. Vartanian, Springfield, VA (US); Margaret Vartanian, Springfield, VA (US)

( * ) Notice: Subject to any disclaimer, the term of this patent is extended or adjusted under 35 U.S.C. 154(b) by 47 days.

(21) Appl. No.: 14/069,622

(22) Filed: Nov. 1, 2013

(65) Prior Publication Data

US 2014/0117178 A1 May 1, 2014

Related U.S. Application Data

(60) Provisional application No. 61/796,092, filed on Nov. 1, 2012.

(51) Int. Cl.
*A47K 3/00* (2006.01)
*B05B 15/06* (2006.01)

(52) U.S. Cl.
CPC ..... *B05B 15/065* (2013.01)

(58) Field of Classification Search
CPC ..... E03C 1/06; E03C 1/066
USPC ..... 248/212, 317, 323, 333, 327, 316.1, 248/316.7, 278.1, 125.8, 75, 159, 200.1, 248/160; 4/617, 601, 570, 615; 239/283, 239/282
See application file for complete search history.

(56) References Cited

U.S. PATENT DOCUMENTS

| | | | | | |
|---|---|---|---|---|---|
| 1,758,115 | A | | 5/1930 | Kelly | |
| 2,100,186 | A | | 11/1937 | Hagopian | |
| 2,759,765 | A | * | 8/1956 | Pawley | 239/588 |
| 2,776,168 | A | | 1/1957 | Schweda | |
| 2,873,999 | A | * | 2/1959 | Webb | 239/588 |
| 3,666,179 | A | | 5/1972 | Peschcke-Koedt | |
| 3,669,362 | A | * | 6/1972 | Meyerhofer et al. | 239/587.3 |
| 3,837,013 | A | * | 9/1974 | Davis et al. | 4/605 |
| 4,174,822 | A | * | 11/1979 | Larsson | 248/75 |
| 4,224,700 | A | * | 9/1980 | Bloys | 4/568 |
| 4,282,612 | A | * | 8/1981 | King | 4/601 |
| 4,744,536 | A | * | 5/1988 | Bancalari | 248/125.8 |
| 4,914,759 | A | * | 4/1990 | Goff | 4/605 |
| 5,833,192 | A | | 11/1998 | Buhrman | |
| 6,315,252 | B1 | * | 11/2001 | Schultz | 248/160 |
| 6,438,767 | B1 | | 8/2002 | Warshawsky | |
| 6,464,265 | B1 | | 10/2002 | Mikol | |
| 7,197,776 | B2 | * | 4/2007 | Tsai | 4/615 |
| 8,292,201 | B2 | * | 10/2012 | Patterson et al. | 239/587.4 |
| 8,371,618 | B2 | * | 2/2013 | Leber | 285/261 |
| 2005/0116062 | A1 | | 6/2005 | Yang | |
| 2010/0006724 | A1 | * | 1/2010 | Steury et al. | 248/214 |

* cited by examiner

*Primary Examiner* — Anita M King
(74) *Attorney, Agent, or Firm* — Matthew Stavish; David Taylor

(57) ABSTRACT

A mounting system for a shower head includes a mounting bracket mounted to a pipe passing through a shower wall, wherein the pipe is part of a shower that delivers water to a shower head. A telescoping arm is affixed to the mounting bracket through a multi-directional joint at a first end of the telescoping arm. A shower head holder is affixed to a second end of the telescoping arm by way of an adjustable joint. The multi-directional joint is formed to rotate and pivot relating to the mounting bracket so that the telescoping arm may be rotated and pivot toward and away from the shower wall in three dimensions.

17 Claims, 9 Drawing Sheets

MOUNTING SYSTEM FOR A SHOWER HEAD

This application claims the benefit of U.S. Provisional Patent Application No. 61/796,092 filed Nov. 1, 2012, the disclosure of which is incorporated herein in its entirety.

BACKGROUND OF THE INVENTION

1. Field of Invention

This invention relates to a shower arm assembly for mounting a hand-held shower head on a wall of the shower surround. More particularly the invention relates to a shower arm assembly having a 3 dimensional and flexible adjustment of the position of the shower head in relation to the connection point on the wall where the flexible hose of the shower head is attached, without damaging the wall and without the use of any tools.

2. Description of Related Art

Whether bathing in the shower stall or in the bath tub typically a person stands in the shower and is sprayed with water through a shower head, which is attached to a shower pipe extending from the central plumbing. A shower head directly attached to a shower pipe is able to be pivoted about the attachment to the shower pipe to provide a certain degree of movement to control the direction of the shower spray. The movement of the shower head is limited to pivotal movement about the connection point to the shower pipe and cannot be translated in any direction.

An improvement to the adjustability of the standard shower head includes the development of the hand held shower head. The hand held shower head includes a flexible hose attached to the shower pipe and a shower head having a handle attachment to the opposite end of the flexible hose. The hand held shower head is typically mounted on a bracket attached to the shower pipe to allow the hand held shower head to be used as a normal shower head, and can normally be pivoted about the attachment of the bracket to the shower pipe. However, the hand held shower head can also be removed from the bracket and held in the desired position with one hand. This allows the user to move the shower head to any desired position however it requires that the user utilize one hand to hold the shower head.

Further developments in shower head positioning includes shower pipe extensions, which include one or more rigid links having one end pivotally attached to the shower pipe and the other end pivotally attached to the shower head, or to another rigid link. The links are typically elongated rigid hoses and allow for limited movement in vertical and lateral directions. The movement is limited by the length of the rigid links and the direction of the movement allowed by the pivotal joints between the links. This type of a rigid link structure often leaks at the joints and can become loose and fail to hold the desired position.

Frequently, adjustable mounts are used in combination with hand-held shower heads to permit the level of the shower head to be lowered from a typical wall mounted shower head level for use by children and disabled. The adjustability of the mount permits the shower head to be changed as the children grow to accommodate their increasing height, and permits temporary repositioning of the shower head when persons of differing heights use the shower. Once the children grow the mounts are usually removed from the shower wall to restore the shower to its original appearance and condition. In the past, removal often damaged the surround because the supports were attached to the wall with semi-permanent means as described above.

There is missing in the art where a shower head assembly allows the variable positioning of the shower head in three dimensions and with any desired distance from the wall and with minimal exposure and space requirement in the shower taking space, while leaving the user with two free hands. It is to overcome the shortcomings in the prior art that the present invention was developed.

SUMMARY OF THE INVENTION

The present invention is a showerhead holder related device. More particularly, the invention is a device for holding a handheld showerhead at multiple heights, angles, positions and distances from the wall where the showerhead hose is attached, without the use of the user's hand(s). The device telescopes, adjusts and fixes the showerhead, to the desired height, position and distance from the wall, within a shower stall.

The device enables hands-free use of a handheld showerhead and increases the distance of the showerhead from the wall with unlimited maneuverability and control. The object is to allow the user to adjust and fix not only the height of the showerhead but also the distance and the angle of the showerhead in relation to the wall where the showerhead is mounted. The device will enable the user to keep the spray of the showerhead over any point without holding it by hand, regardless of where that point is located in the shower taking space.

With some variations of this device the arm can be fixed or be an integral part of the first holder, instead of being mounted on the shower tube which acts as a bridge between the shower head holder and the wall. The telescoping arm can be mounted on the wall separately instead of on the shower pipe. It can also be mounted to any exposed tube of the shower, or on any handle bar in the shower room, or to a specifically attached bar on the wall for this purpose. The telescoping arm can also be substituted by a flexible rod, a folding tube or by a simple non-telescoping tube or rod.

The user can adjust the position, distance and the height of the telescoping arm in relation to the object in the showering area and then anchor the hand-held shower head in the second shower head holder, which is attached at the lower end of the telescoping arm.

There are a number of products on the market that allow the user to adjust the height of the shower head holder on the wall. But none of these products enable the user to adjust the distance of the shower head from the shower wall and position the shower head in any location of the shower-taking area that may be necessary, without detaching and attaching the device every time and without taking up any space in the bath tub or shower stall.

The purpose of this invention is to enable the user of the hand-held shower head to have an increased and complete coverage of the entire space available for showering without holding the shower head by hand. Thus avoiding the necessity and the difficulty to constantly pick up and put back the shower head in its holder, (which is mounted on the wall and away from the user) in order to have both hands free for other tasks.

The invention avoids the necessity of using screws or drilling holes on the wall for attaching the device, or the use of the suction cups, which frequently fall out of the wall. The suction cups which are made to attach to the shower head holders to the floor in the bath tub or shower stall are bulky and get in the way of someone else who does not wish to use it and therefore is compelled to remove and store it. The mounting methods that do not use suction cups are destructive to the tiles and wooden cosmetic and support structures in the bathroom, which are difficult, expensive and time consuming to repair.

Because of its increased reach, flexibility and control this device can also be very useful for washing infants, pets and a variety of objects. This device can be used by all segments of the population but more intensively by people who fall under the following categories: 1. People with disabilities who have difficulty to stand up while taking shower. 2. Elderly adults. 3. People who have infants or small children. 4. People who have pets.

DETAILED DESCRIPTION OF THE PREFERRED EMBODIMENT

Figure 1:
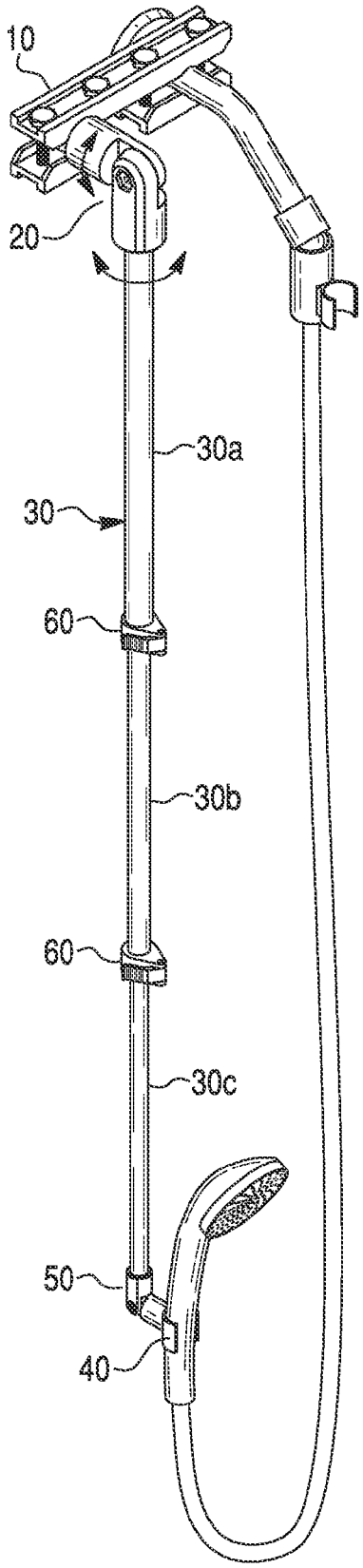
FIG. 1 is a perspective view of the invention mounted to a shower head in the telescoped position.
Figure 5:
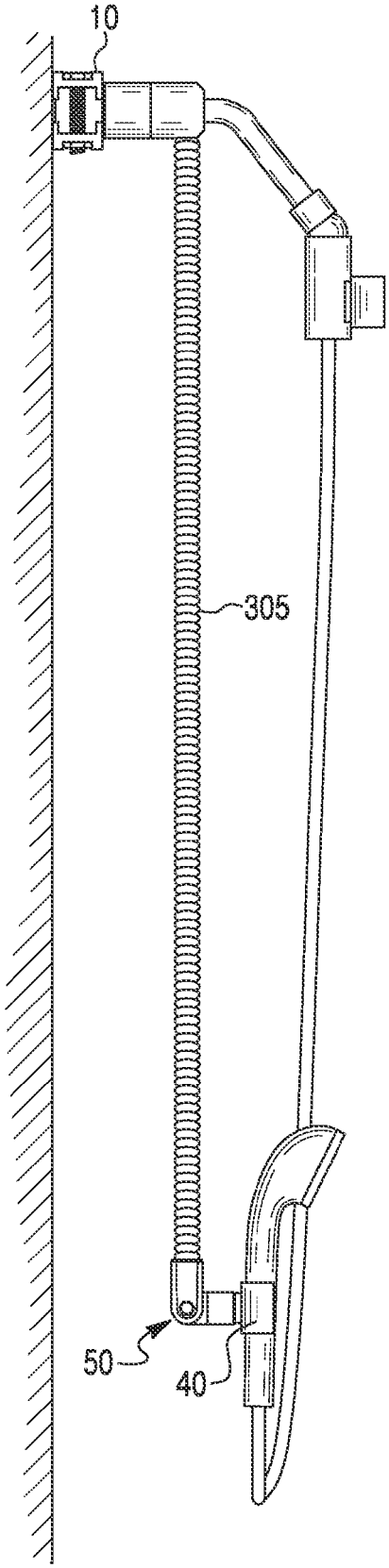
FIG. 5 is a side view of another embodiment showing the arm as a flexible and bendable member.
Figure 6:
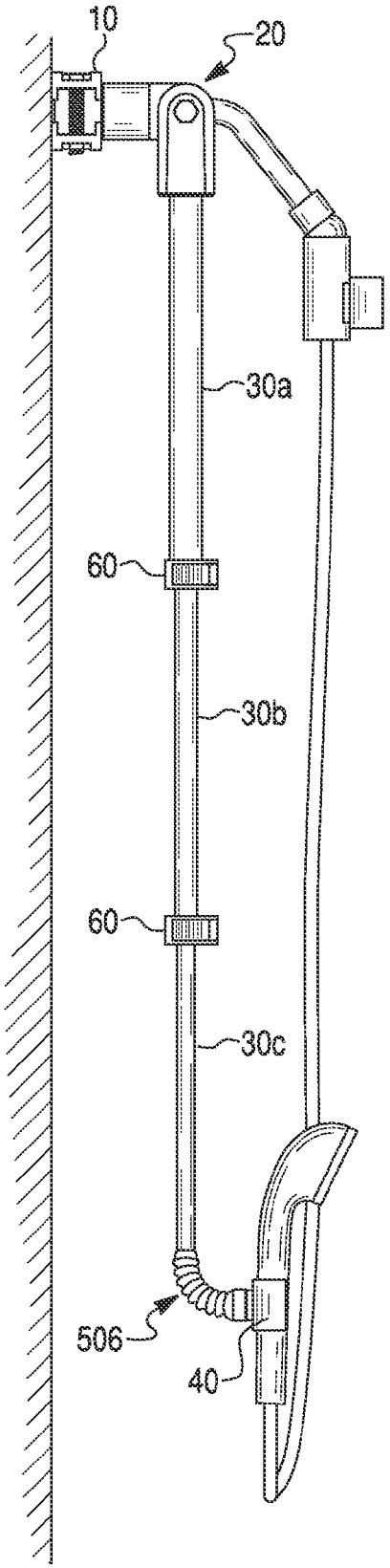
FIG. 6 is a side view of another embodiment showing an adjustable joint as a flexible and bendable member.
Figure 7:
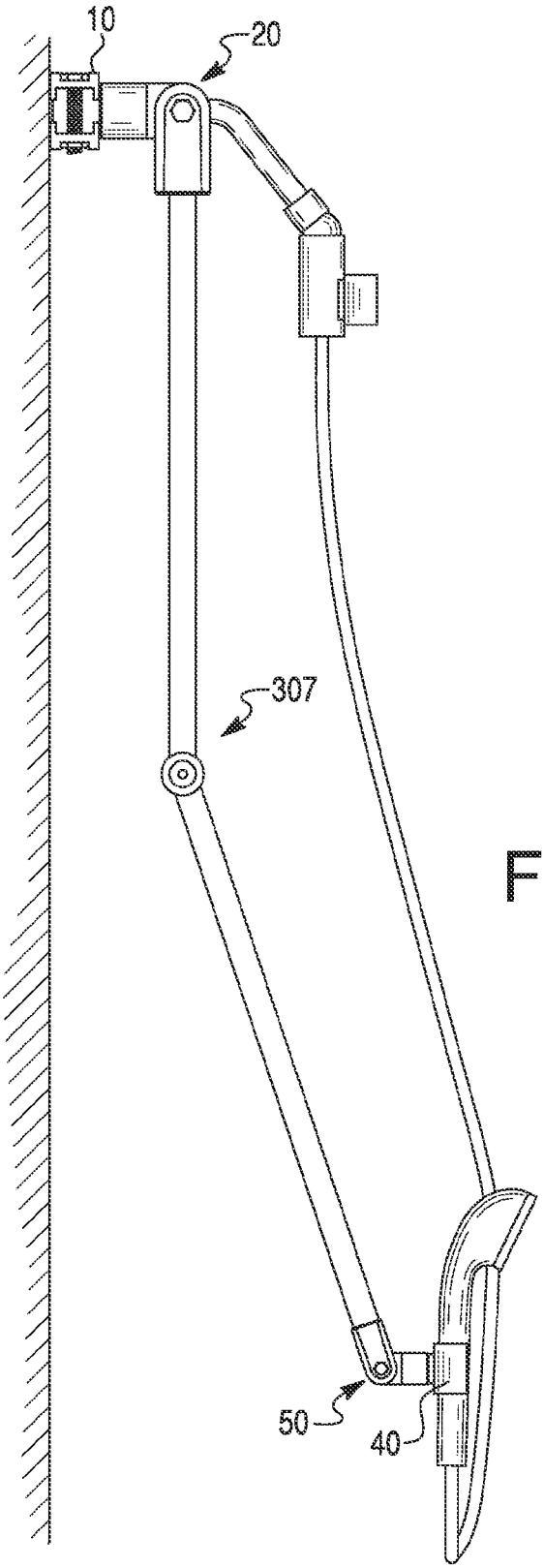
FIG. 7 is a side view of another embodiment showing the arm as a folding tube.

With reference to FIG. 1, the invention includes a mounting bracket 10 adapted to mount the invention to a standard shower head. The mounting bracket 10 is provided with a pivoting and rotating joint 20 that pivots and rotates in multiple directions, and is secured on the showerhead nozzle or on the wall via the bracket 10, or any other tube or bar in the shower taking space. Extending from the joint 20 is a telescoping, adjustable and multidirectional rotating arm 30 which can be mounted on a tube that has water flow in it and bridges the showerhead with the wall, wherein the telescoping arm 30 includes a second showerhead holder 40, which can be similar to the one that is mounted on the wall for anchoring the showerhead to the wall. In the preferred embodiment, the second showerhead holder is provided with a pivoting and rotating joint 50 for additional control and flexibility and for enabling the device to function properly. The arm 30 is formed as a telescoping body extending between the first end and second end. According to another embodiment shown in FIG. 5, the arm 30 may be replaced with a flexible and bendable arm 305. According to another embodiment shown in FIG. 6, the joint 50 may be replaced with a flexible and bendable member 506. According to another embodiment shown in FIG. 7, the arm 30 may be replaced with a folding tube 307.

The telescoping arm 30 is formed of multiple arm sections 30*a*, 30*b*, 30*c* which provide an adjustable length by way of clamp members 60 which lock the arms sections at different lengths.

Figure 2:
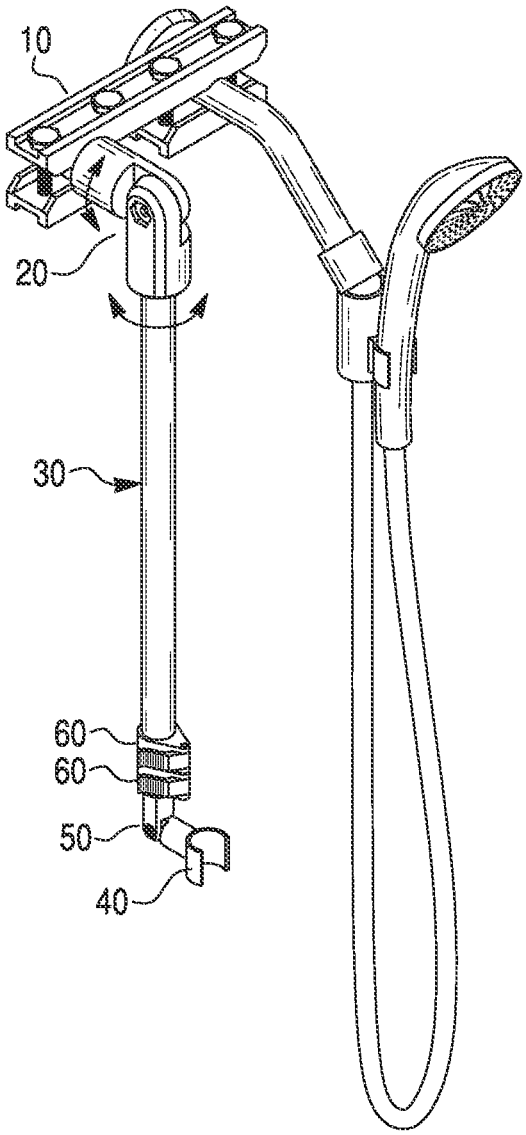
FIG. 2 is a perspective view of the invention mounted to a shower head in the retracted position.

FIG. 2 shows the telescoping arm in the retracted position.

Figure 3:
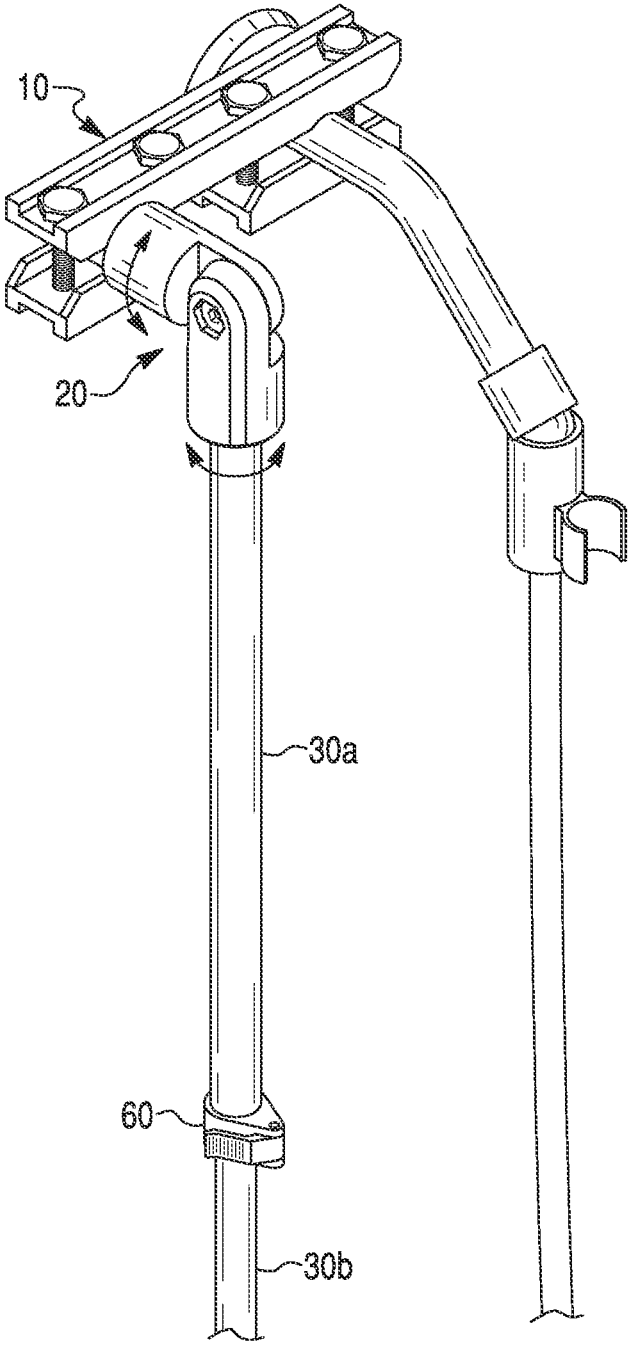
FIG. 3 is a close-up of the mounting system and pivoting bracket.

FIG. 3 is an enlarged view of the mounting bracket 10 and pivoting and rotating joint 20.

Figure 4A:
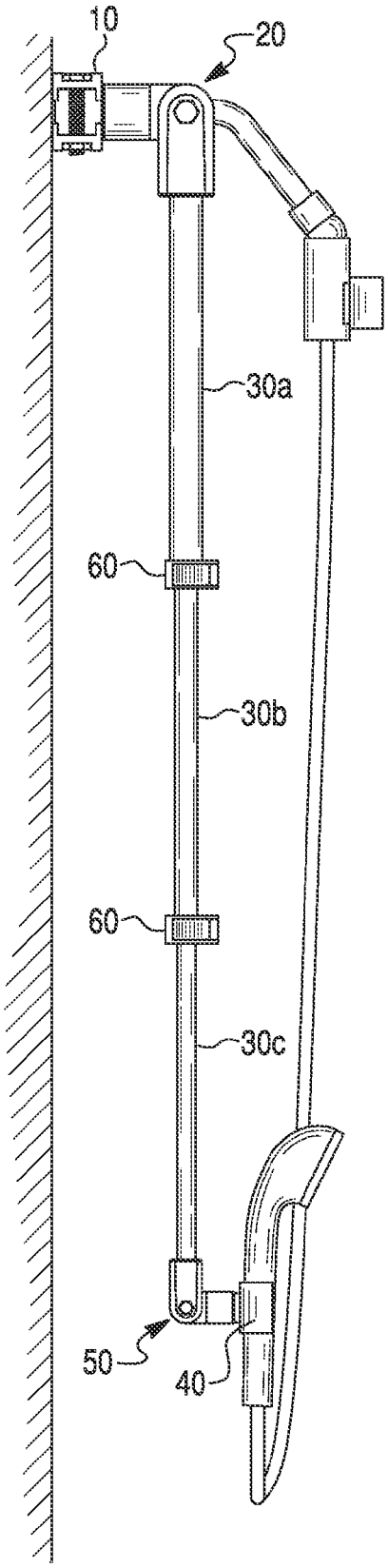
FIG. 4A is a side view of the invention with the arm in the vertical position along the shower wall.
Figure 4B:
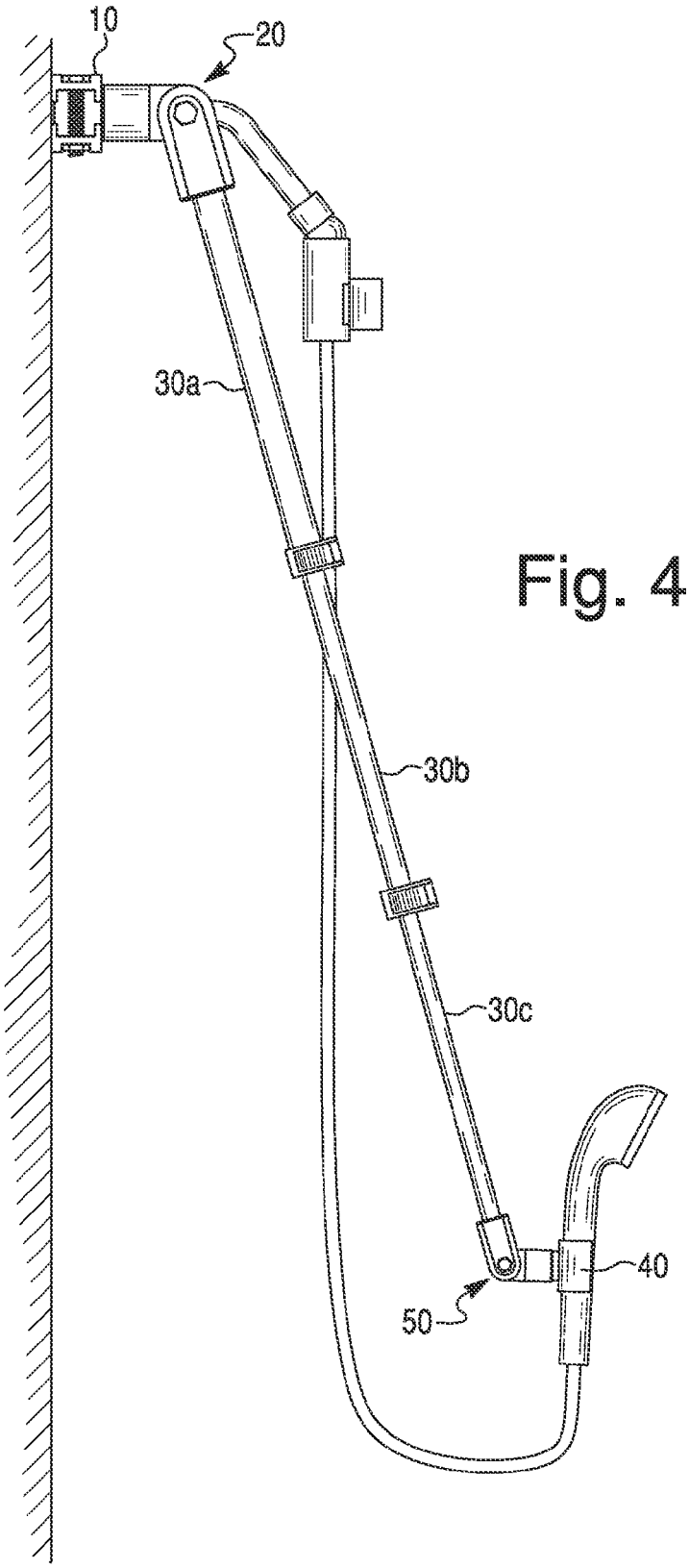
FIG. 4B is a side view of the invention with the arm shown pivoting away from the shower wall.

FIGS. 4A and 4B illustrate side views of the invention with the arm shown in the vertical position along the shower wall (FIG. 4A) and with the arm shown pivoting away from the shower wall (FIG. 4B).

Figure 8:
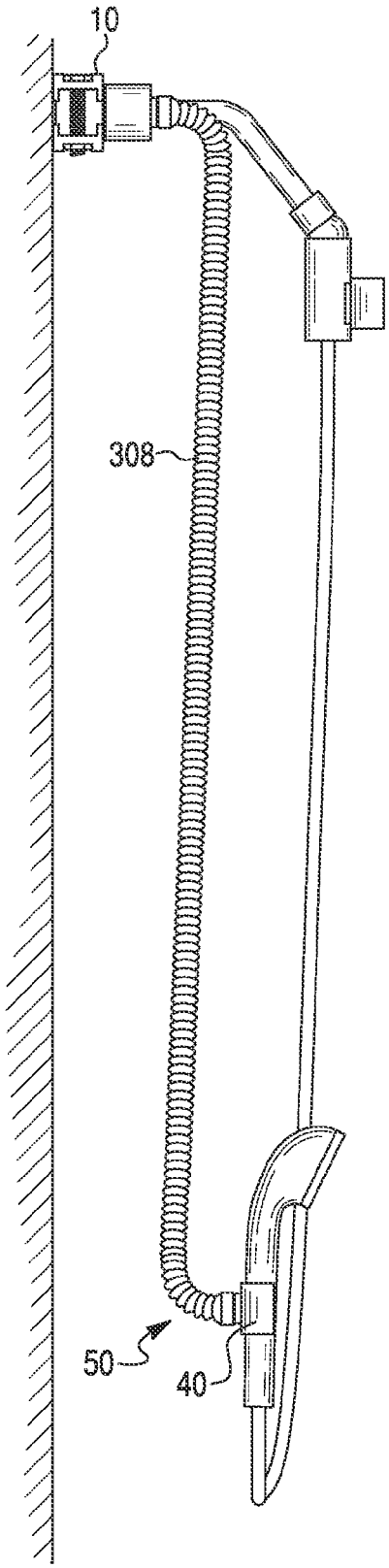
FIG. 8 is a side view of still another embodiment.

FIG. 8 shows a flexible tube 308 substituted for the telescoping arm and its pivoting and rotating joint.

As apparent from the foregoing description, the invention enables hands-free use of a handheld showerhead and increases the distance of the showerhead from the wall with unlimited maneuverability and control. The object of the invention is to allow the user to adjust and fix not only the height of the showerhead but also the distance and the angle of the showerhead in relation to the wall where the showerhead is mounted. The device will enable the user to keep the spray of the showerhead over any point without holding it by hand, regardless of where that point is located in the shower taking space.

While the foregoing invention has been shown and described with reference to a preferred embodiment, it will be understood by those of skill in the art that various changes in form and detail may be made therein without departing from the spirit and scope of the invention.

The invention claimed is:

1. A mounting system for a shower head, comprising:

a mounting bracket adapted to mount to a pipe passing through a shower wall, said pipe being adapted to deliver water to a shower head;

a telescoping arm affixed to said mounting bracket;

a multi-directional joint affixing a first end of said telescoping arm to said mounting bracket; and a shower head holder affixed to said telescoping arm at a second end of said telescoping arm opposite said first end, wherein said multi-directional joint is adapted to rotate and pivot relating to said mounting bracket so that said telescoping arm is rotatable and pivotal in three dimensions with respect to the shower wall.

2. The mounting system according to claim 1, further comprising:

an adjustable joint between said second end and said shower head holder to permit at least one of pivoting and rotating of said shower head holder.

3. The mounting system according to claim 1, wherein said telescoping arm comprises at least two tubes that telescope one within another.

4. The system according to claim 3, wherein said telescoping arm comprises clamp members that adjustably fix said at least two tubes relative to each other.

5. The system according to claim 1, further comprising:

an additional shower head adapted to mount on the pipe passing through the shower wall.

6. The mounting system according to claim 1, wherein said mounting system is configured to be supported only by said mounting bracket and permit the rotatable and pivotal movement of said telescoping arm without mounting or attachment of said mounting system to the shower wall.

7. The mounting system according to claim 1, wherein said arm is a folding tube.

8. The mounting system according to claim 1, further comprising:

an adjustable joint between said second end and said shower head holder to permit pivoting and rotating of said shower head holder about said adjustable joint.

9. The mounting system according to claim 1, wherein said mounting system is adapted to adjust and fix the position of said shower head holder at different positions relative to the shower wall.

10. A mounting system for a shower head comprising:

a mounting bracket adapted to be mounted to a fixture affixed with respect to a shower wall;

an arm affixed to said mounting bracket, said arm being a telescoping arm comprising a plurality of tubes that telescope one within another, a multi-directional joint affixing a first end of said arm to said mounting bracket; and a shower head holder affixed to said arm at a second end of said arm opposite said first end, wherein said multi-directional joint is adapted to rotate and pivot relating to said mounting bracket so that said arm is rotatable and pivotal toward and away from the shower wall.

11. The mounting system according to claim 10, further comprising:

an adjustable joint between said second end and said shower head holder to permit at least one of pivoting and rotating of said shower head holder.

12. The mounting system according to claim 10, wherein said telescoping arm comprises clamp members that adjustably fix said tubes relative to each other.

13. The mounting system according to claim 10, further comprising:

an additional shower head holder adapted to mount on the pipe passing through the shower wall.

14. The mounting system according to claim 10, wherein said mounting system is configured to be supported only by said mounting bracket and permit the rotatable and pivotal movement of said arm without mounting or attachment of said mounting system to the shower wall.

15. The mounting system according to claim 10, wherein said arm is a folding tube.

16. The mounting system according to claim 10, further comprising:

an adjustable joint between said second end and said shower head holder to permit pivoting and rotating of said shower head holder about said adjustable joint.

17. The mounting system according to claim 10, wherein said mounting system is adapted to adjust and fix the position of said shower head holder at different positions relative to the shower wall.

* * * * *